US009188347B1

(12) United States Patent
Ohunna, II

(10) Patent No.: US 9,188,347 B1
(45) Date of Patent: Nov. 17, 2015

(54) REMOTE DISTANCE TRANSPORTING AND INTEGRATING HEAT EJECTION CONNECTED TO CENTRAL HEATING DUCTWORK (AUXILIARY HEAT EJECTORS)

(71) Applicant: Paul N Ohunna, II, Dayton, OH (US)

(72) Inventor: Paul N Ohunna, II, Dayton, OH (US)

(73) Assignee: Home Energy Technologies, Inc., Dayton, OH (US)

( * ) Notice: Subject to any disclaimer, the term of this patent is extended or adjusted under 35 U.S.C. 154(b) by 0 days.

(21) Appl. No.: 13/896,204

(22) Filed: May 16, 2013

Related U.S. Application Data

(60) Provisional application No. 61/696,172, filed on Sep. 1, 2012.

(51) Int. Cl.

| | |
|---|---|
| ***F24D 5/08*** | (2006.01) |
| ***F24D 5/04*** | (2006.01) |
| ***F24D 19/00*** | (2006.01) |
| *F15B 15/00* | (2006.01) |

(52) U.S. Cl.
CPC ..... *F24D 5/04* (2013.01); *F24D 19/0056* (2013.01); *F15B 15/00* (2013.01)

(58) Field of Classification Search
USPC ..... 237/50
See application file for complete search history.

(56) References Cited

U.S. PATENT DOCUMENTS

| | | | | | |
|---|---|---|---|---|---|
| 369,169 | A | * | 8/1887 | Dewey | 237/53 |
| 1,332,164 | A | * | 2/1920 | Degen et al. | 432/62 |
| 2,194,694 | A | * | 3/1940 | Denker | 237/2 R |
| 2,225,071 | A | * | 12/1940 | Meyerhoefer | 237/1 R |
| 2,295,750 | A | * | 9/1942 | Norris et al. | 454/148 |
| 2,468,366 | A | * | 4/1949 | Habinski | 454/352 |
| 2,468,909 | A | * | 5/1949 | Cnossen et al. | 165/299 |
| 2,471,351 | A | | 5/1949 | Russell | |
| 2,598,842 | A | * | 6/1952 | Scott | 237/69 |
| 2,671,395 | A | * | 3/1954 | Demuth | 454/302 |
| 3,057,288 | A | * | 10/1962 | Papsdorf | 454/360 |
| 3,228,318 | A | * | 1/1966 | Wheatley | 49/91.1 |
| 3,453,359 | A | * | 7/1969 | Clement et al. | 264/322 |
| 3,538,728 | A | * | 11/1970 | Trihey | 72/13.6 |
| 3,699,873 | A | * | 10/1972 | Irvin | 454/319 |
| 3,731,056 | A | | 5/1973 | Becker | 219/361 |

(Continued)

FOREIGN PATENT DOCUMENTS

| | | | | |
|---|---|---|---|---|
| DE | 3602212 | A1 * | 8/1987 | F24F 3/052 |
| EP | 2505940 | A1 | 11/2009 | F24B 49/02 |

OTHER PUBLICATIONS

Ductwork by Alpine Home Air Products, http//www.alpinehomeair.comrelatedDuctwork.pdf.

*Primary Examiner* — Gregory Huson
*Assistant Examiner* — Martha Becton

(57) ABSTRACT

Auxiliary heat ejectors (380A, 490) having an optional independent circulator module (380D), heat exchange radiators (41*e*, 41*f*), heated fluid inlet lines (21*e*, 21*f*) and exchange fluid return lines (47*e*, 47*f*) with pumps (49*e*, 49*f*) connected to other tandem modules such as heat sources (30E, 40F) incorporated by reference, a flexible helical corrugated body (53*e*) or a retractable modular unite walls (53*f*) on cart wheels (25*f*), actuators (23*e*, 23*f*), partitions (35*e*, 37*e*, 37*f*), inlet and outlet end having flanges (45*e*, 45*f*, 35*g*) for connecting with shared ductwork of a primary heater. The independent circulator module (380D) comprises of a flexible body (41*g*), support (21*g*), flow check gate (31*g*), a blower motor (27*g*) with propeller 25*g*.

9 Claims, 14 Drawing Sheets

(56) References Cited

U.S. PATENT DOCUMENTS

| | | | | | |
|---|---|---|---|---|---|
| 4,046,320 | A * | 9/1977 | Johnson et al. | 237/8 C |
| 4,049,194 | A | 9/1977 | Tice et al. | |
| 4,130,105 | A | 12/1978 | Melton | 237/1 A |
| 4,131,231 | A * | 12/1978 | Cleer, Jr. | 237/8 R |
| 4,135,440 | A * | 1/1979 | Schmidt et al. | 454/185 |
| 4,143,816 | A * | 3/1979 | Skadeland | 237/8 R |
| 4,179,065 | A * | 12/1979 | Zung | 126/521 |
| 4,191,212 | A * | 3/1980 | Hagar | 137/601.09 |
| 4,217,816 | A * | 8/1980 | Mancinelli | 454/351 |
| 4,276,926 | A * | 7/1981 | Evangelow | 165/300 |
| 4,344,568 | A | 8/1982 | Stewart et al. | |
| 4,360,152 | A | 11/1982 | Schlatter et al. | |
| 4,513,358 | A * | 4/1985 | Lemme | 362/276 |
| 4,775,001 | A * | 10/1988 | Ward et al. | 165/214 |
| 4,794,852 | A * | 1/1989 | Ee | 454/271 |
| 4,962,882 | A * | 10/1990 | Sarazen et al. | 236/49.5 |
| 5,117,900 | A * | 6/1992 | Cox | 165/53 |
| 5,236,391 | A * | 8/1993 | Schaefer | 454/253 |
| 5,238,452 | A * | 8/1993 | Levy et al. | 454/306 |
| 5,253,804 | A * | 10/1993 | Sarazen et al. | 236/44 C |
| 5,288,202 | A * | 2/1994 | Mancinelli | 415/25 |
| 5,347,756 | A * | 9/1994 | Abbott et al. | 49/74.1 |
| 5,522,234 | A * | 6/1996 | Yoo et al. | 62/238.7 |
| 5,899,262 | A * | 5/1999 | Yamaguchi et al. | 165/42 |
| 5,954,266 | A * | 9/1999 | Hoshino et al. | 237/12.3 R |
| 6,029,312 | A * | 2/2000 | Whitney | 15/347 |
| 6,119,044 | A * | 9/2000 | Kuzma | 607/137 |
| 6,276,895 | B1 * | 8/2001 | Milana | 415/25 |
| 6,347,527 | B1 | 2/2002 | Bailey et al. | |
| 6,450,493 | B1 * | 9/2002 | Milillo et al. | 271/11 |
| 6,550,687 | B2 | 4/2003 | Lyons et al. | |
| 6,871,697 | B2 | 3/2005 | Albright et al. | 165/51 |
| 6,960,839 | B2 | 11/2005 | Zimron et al. | 290/2 |
| 7,059,400 | B2 | 6/2006 | Sekhar et al. | 165/205 |
| 7,070,385 | B2 * | 7/2006 | Milana | 415/25 |
| 7,255,096 | B2 * | 8/2007 | Craig et al. | 123/568.12 |
| 7,455,690 | B2 * | 11/2008 | Cartledge et al. | 623/2.37 |
| 7,597,136 | B2 * | 10/2009 | Kite et al. | 165/156 |
| 8,042,496 | B2 | 10/2011 | Min | 122/20 R |
| 8,120,910 | B2 * | 2/2012 | Hong | 361/695 |
| 8,608,157 | B2 * | 12/2013 | Fujikura et al. | 271/31 |
| 8,808,371 | B2 * | 8/2014 | Cartledge | 623/2.37 |
| 2002/0060065 | A1 * | 5/2002 | Ferraro | 165/156 |
| 2002/0151967 | A1 * | 10/2002 | Mikus et al. | 623/1.22 |
| 2002/0174673 | A1 | 11/2002 | Wilkinson | 66/260 |
| 2003/0050693 | A1 * | 3/2003 | Quijano et al. | 623/2.11 |
| 2005/0028970 | A1 | 2/2005 | Sekhar et al. | 165/205 |
| 2005/0149114 | A1 * | 7/2005 | Cartledge et al. | 606/213 |
| 2005/0192601 | A1 * | 9/2005 | Demarais | 606/151 |
| 2006/0240761 | A1 | 10/2006 | Yamaguchi | 454/184 |
| 2007/0209780 | A1 | 9/2007 | Bichler et al. | 165/60 |
| 2009/0188234 | A1 | 7/2009 | Suciu et al. | 60/262 |
| 2009/0194603 | A1 | 8/2009 | Gibbon et al. | 237/48 |
| 2009/0223650 | A1 | 9/2009 | Williams et al. | 165/104.17 |
| 2010/0122794 | A1 | 5/2010 | Mooij | 165/67 |
| 2011/0204720 | A1 | 8/2011 | Ruiz et al. | 307/66 |
| 2012/0083196 | A1 * | 4/2012 | Mockridge | 454/184 |
| 2013/0153076 | A1 * | 6/2013 | Liebson et al. | 138/133 |
| 2013/0213606 | A1 * | 8/2013 | Greber | 165/96 |

* cited by examiner

REMOTE DISTANCE TRANSPORTING AND INTEGRATING HEAT EJECTION CONNECTED TO CENTRAL HEATING DUCTWORK (AUXILIARY HEAT EJECTORS)

FEDERALLY SPONSORED RESEARCH

None

SEQUENCE LISTING

None

BACKGROUND OF INVENTION

This invention relates to apparatus and method of auxiliary heat exchange module used to integrate a remote heating source into sharing ductwork with another heating system. More particularly, the present invention relates to modular heat ejection units configured to distribute heat to a living space by sharing existing ductwork and blower.

The supply and cost economics of meeting domestic energy needs points to alternative sources. There is not one clear dominant alternative source of energy at the present time. However, what appear clear are diversifications in all direction. While pursuing diversification, the cost of the main energy source (fossil) is rising rapidly. Some of the diversification leads to supplemental energy sources instead. Some supplemental energy sources such as fireplaces eject the heat in the vicinity of their location. Traditionally, it makes the location space of the fireplace, say family room, to be excessively warm while farther locations are colder. With increase in auxiliary energy sources comes the need to position and integrate them into existing main ductworks.

An efficient integration would have sole and simultaneous sharing of a distribution ductwork and return system. Various methods have been presented in prior art for integrating and circulating auxiliary heat derived from solid fuel combustion and solar cells into all section of a living space.

PRIOR ART

The following review of prior art represents some of the efforts and deficiencies that have been made in the auxiliary heat exchange integration into one shared ductwork. U.S. Pat. No. 4,360,152 illustrates a solid fuel heat exchanger adapted to preheating cold intake air feeding a conventional heating furnace. This system would require the conventional furnace to be in continuous operation at the same time as the solid fuel fireplace, to use the hot intake air. Substantial shorter life to electrical blower motor always exists when hot auxiliary heat is blown through it. Using an auxiliary heat to preheat a cold air return duct does not present a great value and safety. There is need for a seamless integration for two heaters sharing one ductwork system. U.S. Pat. No. 4,049,194 teaches the system and method of integration of auxiliary fireplace and solar heating systems with air and fluid exchangers for heat storage. The air exchanger is large and laborious to install on an existing chimney brick wall. There is need for integrating a heat source that does not require extensive labor and construction.

U.S. Pat. No. 4,130,105 illustrated an auxiliary forced air exchanger for wood furnace connected to hot air distribution and cold air return duct of a conventional forced air furnace. This system has a pre-fireplace blower and ducts leading into the existing main furnace circulation ductwork. Four large ducting holes will be made through existing chimney brick wall during installation. Additionally, most fireplaces are located in the family or living room where ductwork will be unsightly. It is also noted that the flue of the fireplace and main furnace are joined which is against both National Fire Protection Association and Chimney Safety Institute of America rules. The result could be deadly. There is need for auxiliary heat ejector integration that will meet standards of safety, be cost effective, out of sight and less labor intensive.

U.S. Pat. No. 6,550,687 describes a system and a method for exchanging heat from fireplace to heating air intake of a structure. This art implies that the central hot air furnace and the fireplace heat source must be operated at the same time to utilize or get any benefit of this method. There is need for an auxiliary heater that can perform at high efficiency when main system is idle or down.

DISADVANTAGES

Collectively, the prior art present permanent intrusive and obstructive presence in the air circulation system. Particularly when they are not in operation and contributing as energy source in the ductwork system, their presence are not minimized. The presence of these auxiliary heat ejectors creates circulation system turbulence and resistance to air flow without compensation. The rate of flow is diminished unnecessarily. There is need to minimize obstruction and presence of auxiliary heat ejectors in an existing main ductwork.

Many of the prior art use hot air to transport heat energy from heat source to a plenum. Air would not be efficient for long distant transfer of heat because it is voluminous and low in heat capacity. In addition, a very tedious construction work is needed to bore two (in some cases four) large holes through brick chimney walls for air ducts that will connect fireplace heat exchanger and main heater plenum in a distant location. Also, air is inefficient and does not retain heat content over a long distance, say from the fireplace to central heater plenum in the basement of a house. There is the need to reduce construction and installation cost, eliminate labor, increase effectiveness and efficiency.

Some of the prior art supply the auxiliary heat to the return air of a primary heating unit. The auxiliary heated air goes through the blower electric motor of the main heating unit. Electric motors are typically not designed to intake non-ambient (hot) temperatures. Such installation could cause electric motor overheat, and short life or burnout of the motor. On another review, passing heated air from an auxiliary heat source through the main heater elements is inefficient. Where the main heating unit is off and only the blower is on, the auxiliary heat energy input from the return air will be absorbed by the main heating unit elements, radiator and blower before the heat reaches the desired living space. Therefore, the net value of the energy gained is diminished. There is the need for auxiliary heat exchanger that ejects heat directly into the distribution ductwork of the main or primary heating unit.

SUMMARY OF THE INVENTION

The embodiments of the auxiliary, remote distance transporting and integrating heat ejectors of the present invention are directed generally to devices used to integrate hot fluid source to share a ductwork system for supply and distribution of thermal energy. More particularly, this invention relates to an alternate heating source (or supplemental heating source), sharing ductwork and blower solely, alternately and simultaneously with another heating source in a ductwork circulation system to provide efficient additional heating for multiple sections of space to be heated. One flexible auxiliary heater of the present invention consist of and embodies: a flexible body; a heat ejector; connection means and mount for connecting to a ductwork having a primary heater with blower and return air; a short shared and a long sole partition of the ductwork stream; a fluid pump; and an actuator with recoil spring that opens and closes the shared/sole partition.

An alternate projection auxiliary heat ejector embodies telescopic insertion and retraction means into the ductwork air flow path. The projection auxiliary heater actuates the shared or sole partitioning and activates a fluid pump. The projection auxiliary heater further embodies radiators in a cart on wheels. For heat exchange efficiency, the heat carrying fluid in the radiators flow counter-current to the ductwork air blowing direction through the auxiliary heater.

Another embodiment is an optional independent circulator module to connect the auxiliary heaters to air return for independent operation. The independent circulator module comprises of a flexible body with blower, support, and flanges for connection. The independent circulator module has backflow check guard in the inlet end that connects to the air-return ductwork system to prevent backflow.

In another embodiment, a hollow helical heat reclaimer smoke condenser, incorporated by reference, is used inversely as a heater and the draft inducer, incorporated by reference, is used as a blower at the inlet position of the heater. In yet another embodiment, a modified universal flue pipe connector with damper and sweep access, incorporated by reference, is used in both inlet and outlet to connect one or multiple heater and heat sources to ductworks.

The present embodiment presents apparatus with capability of sole, partial or simultaneously utilization of the existing ductwork. These auxiliary heaters eject heat directly into the distribution ductwork, reduce installation cost and labor and minimize presence or obstruction in a ductwork.

Accordingly, one or more of the embodiments offer several advantages as follows: providing auxiliary, transporting heat ejector apparatus with capability of sole, partial or simultaneously utilization of shared ductwork, having on-demand or no presence in a ductwork, ejects heat directly into the distribution ductwork, can be easily manufactured, reduces installation cost and labor and minimize obstruction and presence of auxiliary heat ejectors in a shared main ductwork. These and other advantages of one or more aspects of the instant disclosure will be more readily apparent in light of the following drawing and representative illustrations:

DRAWINGS

Figures

Drawings: Reference Numerals

Figure 1:
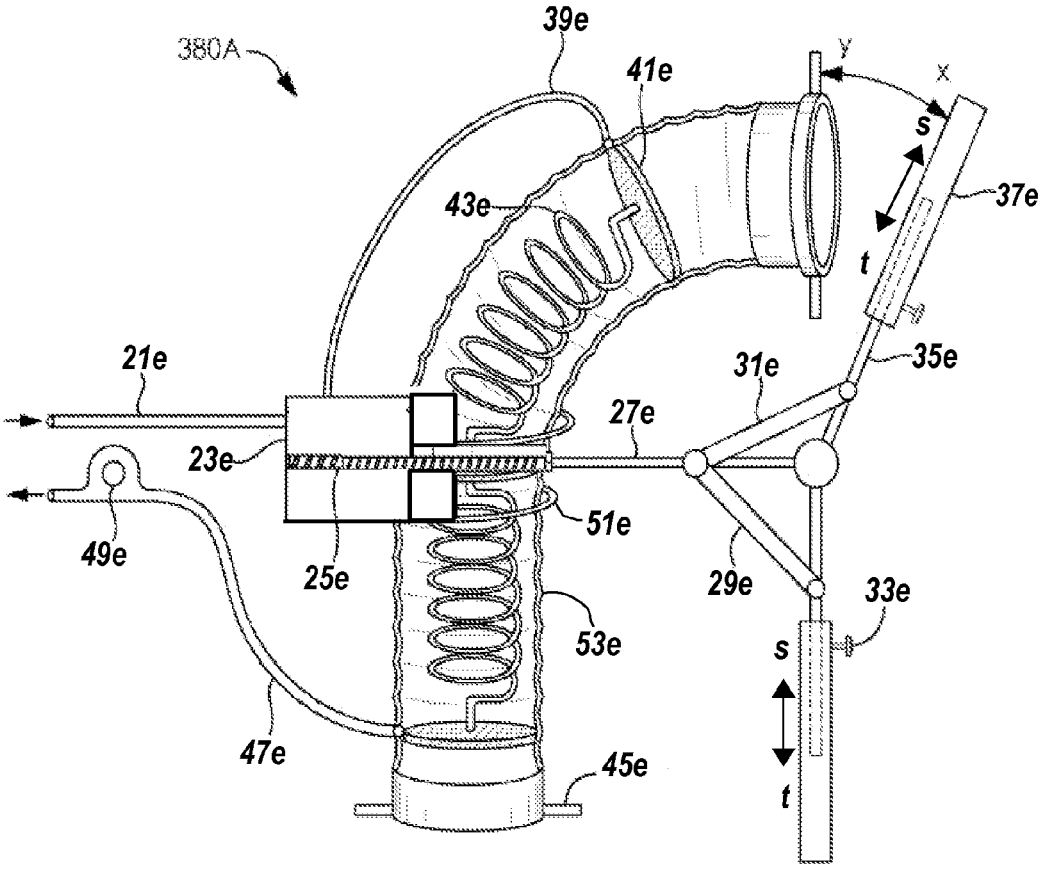
FIG. 1 shows side view of one embodiment of flexible integrating heat ejector with cutout section showing radiator and coil in the inside structures.

| | | |
|---|---|---|
| | | 21g auxiliary support |
| 23e actuator | 23f actuator | 23g power supply |
| 25e recoil springs | 25f cart wheel | 25g blower propeller |
| 27e actuator piston | 27f projection telescopic piston | 27g blower motor |

-continued

| Drawings: Reference Numerals | | |
|---|---|---|
| 29e U-partition controller | 29f blower module connection | 29g adjustable support |
| 31e L-partition controller | 31f partition telescopic controller | 31g flow check gate |
| 33e sole-share adjuster | | 33g height adjust screw |
| 35e share partition | 35f partition controller point | 35g flanges |
| 37e sole partition | 37f sole-share partition | 37g outlet connection |
| | | 39g inlet connection |
| 40 draft inducer, similar to the Propeller Hollow Draft Inducers. | | |
| 30E Energy system containing inducer (40) | 40F Energy system containing inducer (30) | |
| 41e Heat Exchange radiator | 41f heat exchange radiator | 41g flexible body |
| 43e connecting tubular coil | | 43g connection mount |
| 45e flanges | 45f flanges | |
| 49e pump | 49f pump | |
| 50 draft inducer, like the Impeller Hollow Draft Inducers. | | |
| 51e actuator fastener | 51f radiator piston connector | |
| 57e air return duct | 57f actuator support | |
| 59e primary blower | 59f cart rails | |
| 61 brick chimney wall | 61f module connection | |
| 63 flue pipe | 67a insert stove | 69e hot fluid line |
| 71e cold fluid return line | 81e primary heater | 83e exchanger fluid inlet |
| 85e plenum | 87e main return check gate | |

110 heat extractor, similar to the Heat Reclaimer Smoke Condenser.

380*b* back of flexible auxiliary heater

380*c* installed flexible auxiliary heater

380*d* independent circulator module recovery modules comprising: impeller draft inducer, heat reclaimer smoke condenser, flexible universal connector and a combustion appliance insert in a chimney fireplace

710 connector,

905D damper hole sealer, like Ventinox$^R$ Connector seal kit

| | | |
|---|---|---|
| New: 21e Insulated heated fluid inlet pipe | 21f Insulated heated fluid inlet pipe | |
| New: 22e Cold fluid inlet | 22f Cold fluid inlet | |
| New: 24e High voltage utility | 26e Step-down transformer | |
| New: 28e AC-DC rectifier | 30e Rechargeable accumulator | |
| | 39f hot fluid coil | |
| New: 47e Cold Fluid outlet line | 47f Cold Fluid outlet line | |
| 32e Electric switch | 34e Electric powered | |
| 36e Hydraulic powered | 38e Actuator metal beam | 42e Insulating Layer |
| 40e Electrical wiring | 53e Corrugated body | |
| 380a Transporting Heat Ejector | 33f cart | 53f Insulated container body |

380*e* installed auxiliary heater independent circulator

380*f* installed flexible auxiliary heater connected to a heat recovery source comprising of draft inducer, heat reclaimer smoke condenser, access connector and a combustion appliance insert in a chimney fireplace

380*g* installed auxiliary heater with independent circulator module connected to a front view of heat recovery source comprising of draft inducer, heat reclaimer smoke condenser, access connector and a combustion appliance insert in a chimney fireplace

380*h* installed auxiliary heater with independent circulator module and connected to a side view of heat recovery modules comprising: draft inducer, heat reclaimer smoke condenser, access connector and a combustion appliance insert in a chimney fireplace

390 retractable auxiliary heater

390*a* installed retractable auxiliary heater

390*b* installed retractable auxiliary heater with independent circulator module operating with main furnace blower.

390*c* installed retractable auxiliary heater operating with independent circulator module.

390*d* installed retractable auxiliary heater and connected to a side view of heat recovery modules comprising: propeller draft inducer, heat reclaimer smoke condenser, access connector and a combustion appliance insert in a chimney fireplace

390*e* installed retractable auxiliary heater with independent circulator module and connected to a side view of heat

DETAILED DESCRIPTION OF THE EMBODIMENTS

Construction: FIGS. 1, 1A, 2, 3, 1B

Figure 1A:
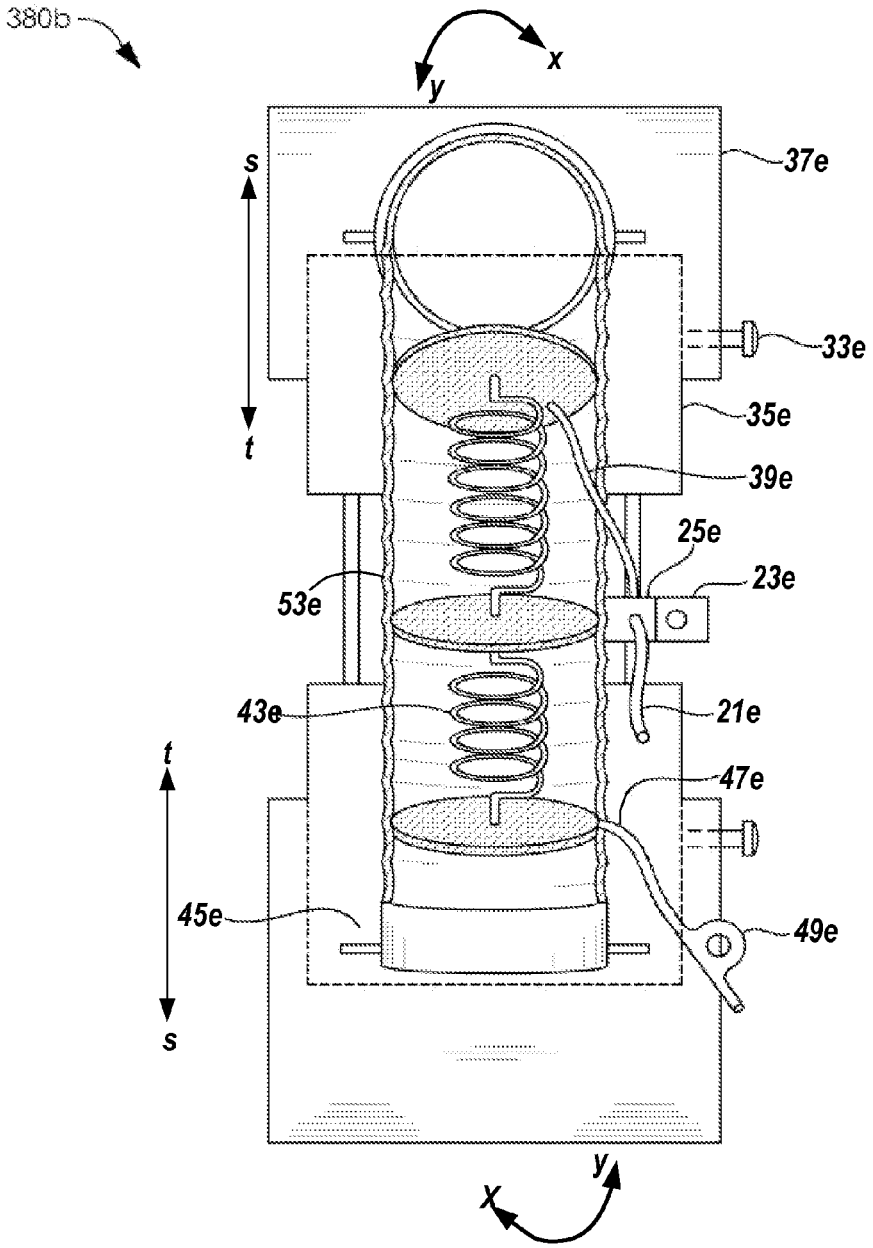
FIG. 1A shows back view of one embodiment of flexible remote transferring heat ejector with cutout section showing radiator and coil in the inside structures.

One embodiment is illustrated in FIG. 1 as side view of a transporting auxiliary heat ejector 380A and in FIG. 1A as back view of the auxiliary heat ejector 380B. The transporting heat ejector 380A has flexible, helical corrugated, multilayer layer body 53*e* in FIG. 1B and at least two open ends for connecting to ductwork plenums or other modules and form a closed loop air distribution. The helical corrugation reduces pressure loss by causing cyclonic flow which is more laminar due to the tight spiral design. The corrugated body 53*e* encloses series of heat exchange radiators 41*e* interconnected head-to-tail by stretchable tubular coils 43*e* from one end of the body 53*e* to the other. One end of an insulated inlet pipe 21*e* is connected to the outlet of a heated fluid source and the other end is connected to the first radiator 41*e*. An outlet pipe 47*e* is connected to the last radiator in the series inside the flexible body 53*e* and the other end of the outlet pipe 47*e* is connected to a fluid pump 49*e* which is connected to a return inlet of a heated fluid source or alternatively to a hydraulic actuator 32*e*. The outlet from the hydraulic actuator is connected to a return inlet of a heated fluid source. The connections form a closed loop with a fireplace heated fluid source inlet and outlet and a counter current closed loop distribution air flow with the ductwork venting and return circulation system. In FIG. 11*d*, heated fluid $H_f$ flows from heat source (optionally through the hydraulic actuator) into the radiators 41*e* clockwise or southwards and a heat exchange air flows Ar and Br from ductwork air return 57*e*, through the radiators in opposite direction in a maximized counter current exchange arrangement. The open ends of the body 53*e* have flanges 45*e* for connecting to a plenum or self-modular replicating connection or another modular unit connection. The stretchable tubular coils 43*e* and the helical corrugated body 53*e* lends to the flexibility of the flexible auxiliary heat ejector 380A.

The transporting heat ejector 380A has two sole-partitions 37*e* sliding over two share-partitions 35*e*. The two sliding sole-partitions 37*e* are adjusted and held in desired position by with a sole-share adjusters 33*e*. The heat ejector 380A can use the ductwork in a sole S or shared t position by adjusting with the sole-share adjuster 33*e*. The Two share partitions 35*e* are pivotally connected to actuator piston 27*e* and to two partition controllers 29*e* and 31 *e* which are also connected to the actuator piston 27*e*. The actuator piston 27*e* is connected to an actuator 23*e*. The actuator 23*e* is attached to the corrugated body 53*e* by actuator fasteners 51*e*. A pump 49*e* is connected to the cold fluid outlet line 47*e* which pumps the fluid to optionally through the actuator 23*e* to cold fluid inlet line 22*e* of a heat source. A heating source outlet connects heated fluid inlet line 21*e*. As another option, the fluid inlet line 21*e* is connected through the actuator 23*e* to a hot fluid intake line 39*e*. The hot fluid intake line 39*e* is connected to the first heat exchange radiators 41*e* which is connected in head-to tail series by tubular coils 43*e*. The last heat exchange radiator 41*e* connects to exchange cold fluid outlet line 47*e* which connects to the pump 49*e* to complete a closed-loop. The actuator 23*e* has power options such as electric or hydraulic or both. Where the actuator is hydraulic powered, the pump 49*e* provide the fluid force from the inlet line 21*e* or alternatively the outlet line 47*e* which is connected to actuates the actuator 23*e*. After the actuator, the fluid passes to connects to the hot fluid intake line 39*e* and then to the heat exchange tunnel of radiators 41*e* and coils 43*e*. The pump may be optionally powered by a higher utility AC volts or step down transformed and rectified volt DC with a backup rechargeable battery which provides for operation in event of power failure. The share partitions 35*e* opens from Y to X position as the actuator piston 27*e* and the partition controllers 29*e*, 31*e* move forward. When the actuator 23*e* is turned off or there is a system power failure, a recoil spring 25*e* pulls back the actuator piston 27*e* which closes share partitions 35*e* from X to Y. The auxiliary heater 380A is then out of the way and the ductworks is turned over to the other heater's sole operation.

Figure 3:
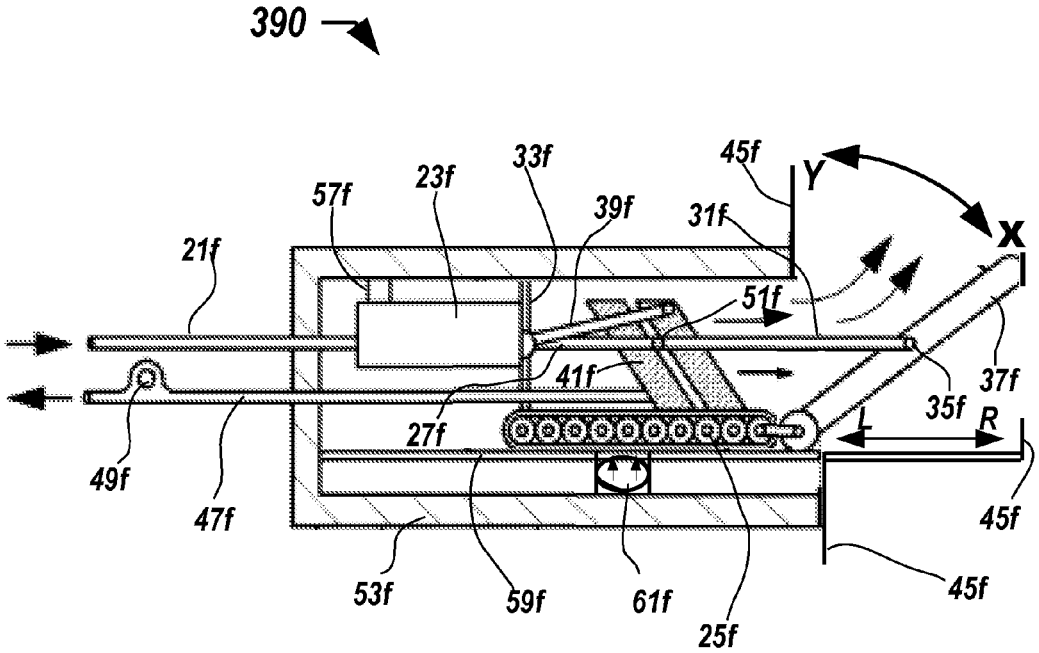
FIG. 3 shows cross sectional side view of another embodiment of projection auxiliary heater showing actuator and radiator in a wheeled cart in the inside structures.

An alternate embodiment is illustrated in FIG. 3 as side view of a projection auxiliary heater 390. The projection auxiliary heater 390 has rectangular container body 53*f* and the open ends have flanges 45*f* for general nuts and bolts, rivets, screws or clamps connecting to a plenum or another modular unit. The container body has module connection 61*f* under and between a pair of parallel cart wheels 25*f* for independent blower module connection. The container body 53*f* encloses heat exchange radiators 41*f* stacked in an enclosed cart. The cart 59 on a pair of parallel cart wheels 25*f* rest on two parallel cart rails 59*f* which runs the entire floor of the container body 53*f* across to an opposite end of a plenum. The heat exchange radiators 41*f* are stacked and connected in series to maximize counter current flow of heat exchange. An actuator 23*f* is attached inside the container body 53*f* by actuator fasteners 57*f*. A two stage telescopic actuator piston comprising of a second sage projection telescopic piston 27*f* and a first stage partition telescopic piston 31*f*, projects from the actuator 23*f* to a partition controller point 35*f* connected to a sole-share partition 37*f*. The sole-share partition 37*f* is pivotally connected to the end of the cart wheels 25*f*. When actuator 23*f* is actuated, the partition telescopic piston 31*f* moves forward as the first stage projection to pivots the sole-share partition from position Y to desired preset position X. The preset position X is determined by the length of the partition telescopic piston 31*f*. The partition telescopic piston 31*f* has internal recoil spring for reverse motion when actuation is turned off. In second stage, the projection telescopic piston 27*f* pushes the cart wheel 25*f* to rotate and the cart with heat exchange radiator 41*f* moves from left position L to right position R and the cart rail 59*f* and has recoil spring for reverse motion when actuation is turned off.

A pump 49*f* is connected in the exchange cold fluid outlet line 47*e* which takes the fluid optionally to a hydraulic actuator and then to inlet of any heat source and subsequently to a heated fluid inlet line 21*f*. The pump operates with utility AC volts or optional step down transformed and rectified DC current and backup rechargeable battery which provides for operation in event of power failure. The fluid inlet line 21*f* passes the actuator 23*f* and is connected through hot fluid intake line 39*f* to the heat exchange radiators 41*f* and exit back to exchange cold Fluid outlet line 47*f* in a closed loop. The actuator 23*f* has power options such as electric or hydraulic. Where the actuator is hydraulic powered, the pump 49*f* provides hydraulic force from the heated fluid inlet line 21*f* to flow into and actuates the actuator 23*f*. The fluid then passes the actuator through a coil of hot fluid inlet 39*f* into the top stack of heat exchange radiators 41*f* and exit at the bottom through exchange cold Fluid outlet 47*f* line. The projection auxiliary heater 390 can use a ductwork in sole or shared partition of the duct by adjusting the length of the first stage partition telescopic piston 31*f*. Adjusting the length of first stage partition telescopic piston 31*f* changes the maximum angle of the sole-share partition 37*f* which corresponds to usage from 0 to 100% of the ductwork. Controlled by the partition telescopic piston 31*f*, the sole-share partitions 37*f* opens completely from Y to X or anywhere in between for sharing ratio. When the actuator 23*f* is turned off, the recoil spring of partition telescopic piston 31*f* pulls back the piston which closes sole-share partitions 37*f* from X to Y and R to L. The auxiliary heater 390 is then out of the way and the ductwork is turned over to the other heater's sole 100% usage.

Figure 2:
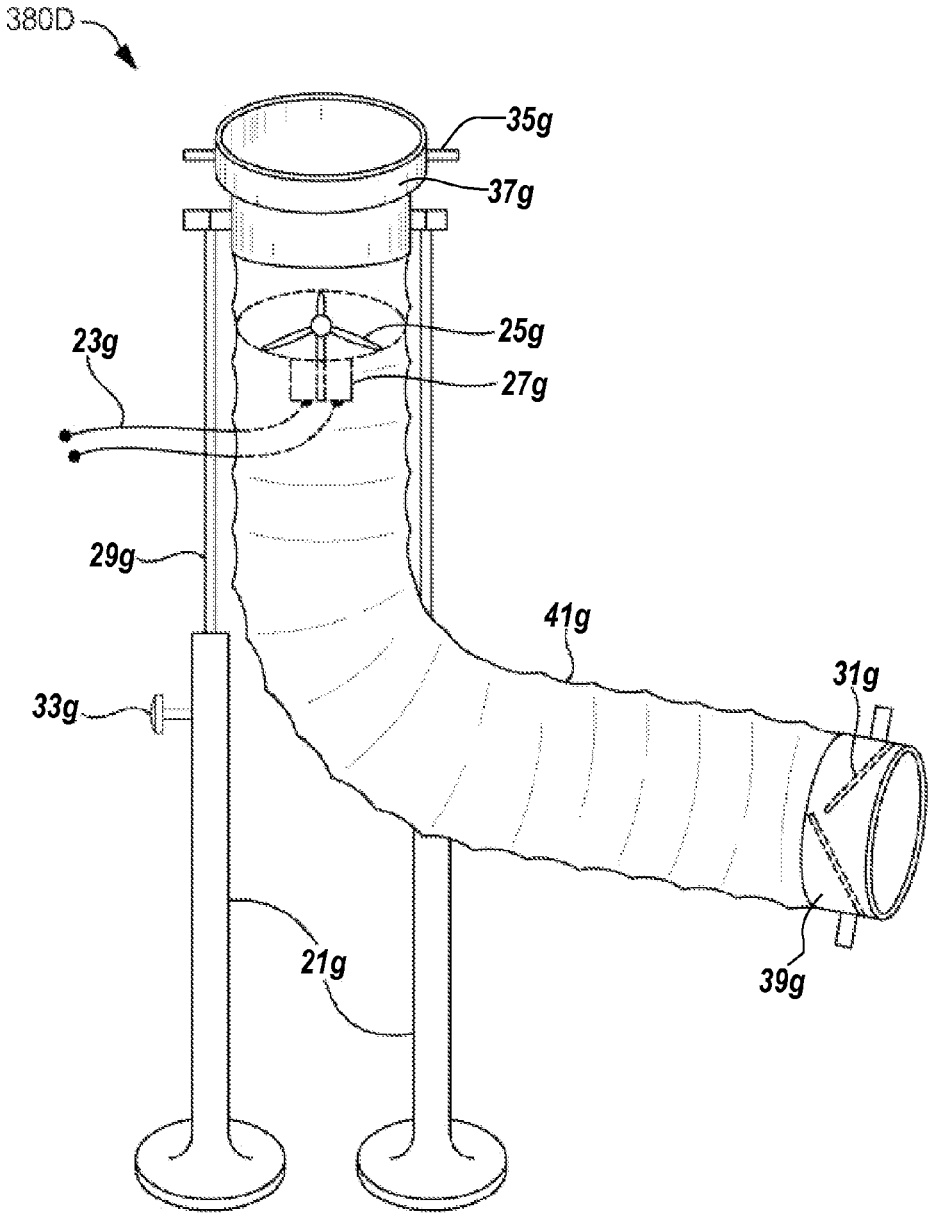
FIG. 2 shows one embodiment of a flexible independent circulation module for auxiliary heaters with a blower in the inner structure.

An optional embodiment is illustrated in FIG. 2 as independent circulator module 380D. The independent circulator module provides compliments to the versatile operation of the transporting heat ejector 380A and projection auxiliary heater 390. It provides an on-demand module that provides for operation in event of power failure. The independent circulator module 380D has flexible, helical corrugated body 41*g* made of galvanized steel, mild steel or such materials suitable for ductwork. The helical corrugation reduces pressure loss by causing cyclonic flow. The independent circulator module 380D may be stretched or collapsed to fitting length. The corrugated body 41*g* encloses a blower comprising of a power supply 23*g*, propellers 25*g* and a blower motor 27*g*. The blower motor 27*g* may be optionally powered by utility AC volts or optional step down transformed and rectified volt DC current and backup rechargeable accumulator. The inlet end of the independent circulator module 380D has inlet connection 39*g* with flanges 45*g* adopted for versatile nuts and bolts, rivets, screws or clamps connection to the ductwork return. The outlet end of the independent circulator module 380D has outlet connection 37*g* with flanges 35*g* for connecting to a heater or another modular unit. The inside of corrugated body 41*g* is provided with a flow check gate that closes in the event of back pressure flow. A detachable auxiliary support 21*g* is provided for supporting the weight of the independent circulator module 380D and or any module such as the projection auxiliary heater 390. The auxiliary support 21*g* has an adjustable support 29*g* and a height adjust screw for proper height and balanced level support.

The independent circulator module provides compliments to the versatile operation of the heat ejector 380A and heat ejector 390. It provides an on-demand module which provides for operation in event of power failure. When projection auxiliary heat ejector 390 is connected to the independent circulator module, projection auxiliary heat ejector 390 has the capability and choice of using the primary heater blower or the independent circulator module 380D. This choice and capability is not available with the pairing of flexible auxiliary heat ejector 380A and independent circulator module 380D without a third opening modification.

Figure 1B:
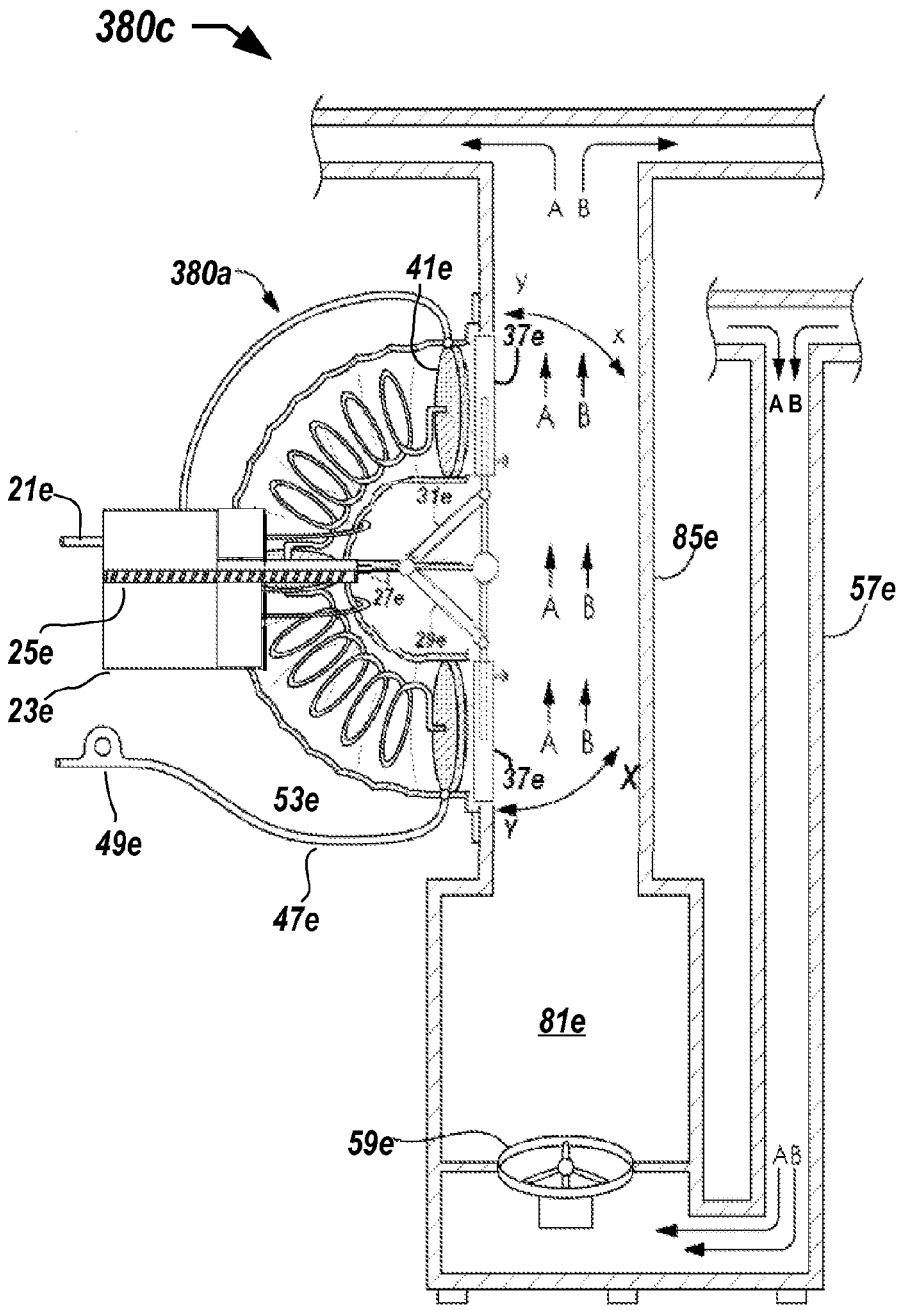
FIG. 1B shows side view of one embodiment of an unactuated heat ejector installed in closed loop with a plenum of a central circulation ductwork with cutout section.
Figure 1C:
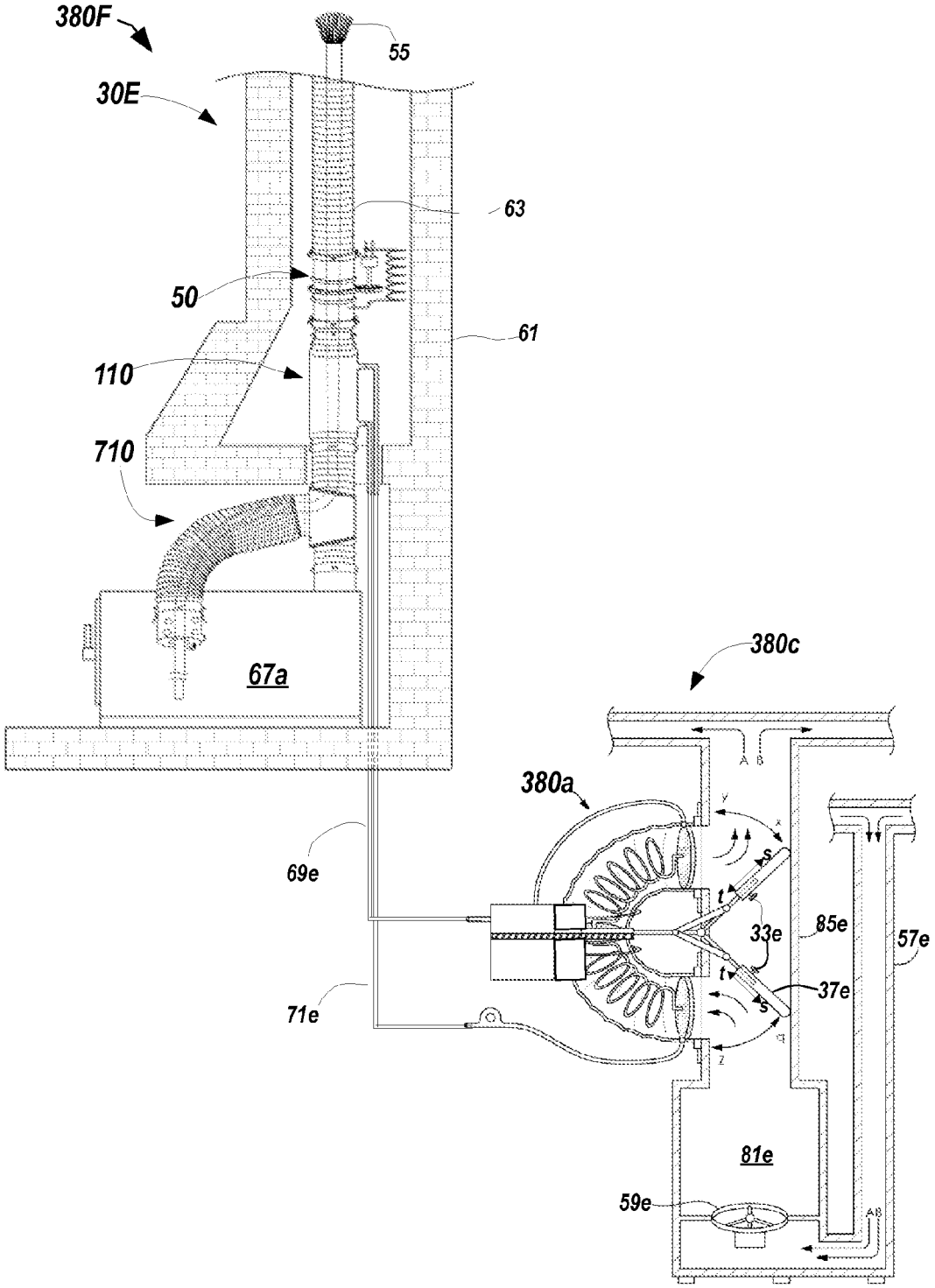
FIG. 1C shows side view of one modular tandem of Access connector on a solid fuel appliance in a chimney, combined with hollow heat reclaimer smoke condenser and hollow draft inducer connected to the flexible auxiliary heat ejector combined as a module connected and installed in a central circulation ductwork with a primary heater.

Applications: FIGS. 1B, 1C, 3A, 3B, 4, 4A, 4B, 5, 5A, 5B One application of the embodiments of the flexible auxiliary heat ejector 380A is illustrated in FIG. 1B generally regarded as installed transporting heat ejector 380C. The heat ejector 380C comprises of the flexible auxiliary heat ejector 380A installed in a plenum 85*e* of a ductwork with a primary heater 81*e*, an air return duct 57*e* and a primary blower 59*e* blowing an circulation stream A and B. Where there is no actuation, the partition remains at Y position and the primary heater has 100% unobstructed use of the ductwork. It has zero impact or zero failure effect on other systems such as a host furnace 81*e* sharing the ductwork. FIG. 1C installation shows that when partition is actuated from Y to X and sole partition 37*e* adjusted from T to S, A and B stream go through the transporting heat ejector 380A making 100% use of the ductwork. An actuation that leaves the share partitions 35*e* between Y and X or an adjustment that leaves the sole partition 37*e* near between S and T will result in a shared ductwork where stream A flow through the transporting heat ejector 380A and stream B passes through the primary furnace 81*e* only.

Figure 4:
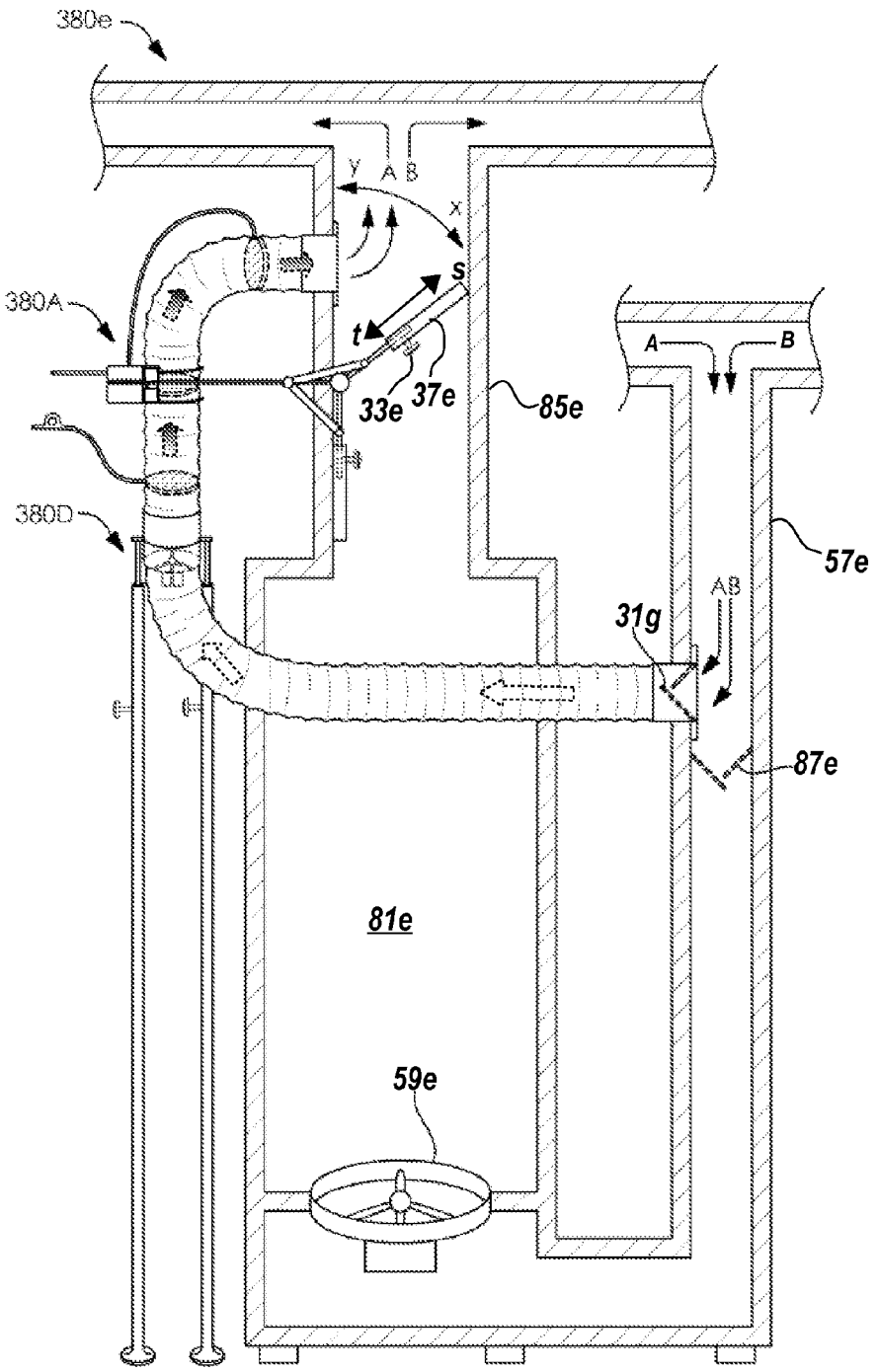
FIG. 4 shows side view of one embodiment of flexible heat ejector combined with a flexible independent circulation module installed in a plenum of a ductwork air distribution vent and return system.

Another application of the embodiments of the transporting heat ejector 380A using the independent circulator module 380D is illustrated in FIG. 4 generally regarded as installed auxiliary heater independent circulator 380E. The installed auxiliary heater independent circulator 380E consists of the transporting heat ejector 380A installed in a plenum 85*e* of a ductwork with of a primary furnace 81*e*, an independent circulator module 380D connected to an air return duct 57*e* and a primary blower 59*e* blowing an arbitrary circulation stream A and B. The installation shows that the circulation streams A and B can form its own independent circulation loop through the independent circulator module 380D, bypassing the primary furnace 81*e*. To give the independent circulation loop a 100% use of the ductwork, the partition is actuated from Y to X and sole partition 37*e* adjusted from T to S. An actuation that leaves the share partitions 35*e* between Y and X or an adjustment that leaves the sole partition 37*e* near between S and T will result in a shared ductwork where stream B flow through the transporting heat ejector 380A and stream A passes through the primary furnace 81*e* only. Where there is no actuation, the share partitions 35*e* closes-out the installed auxiliary heater independent circulator 380E by remaining at Y position and the primary heater has 100% unobstructed use of the ductwork. With the use of the independent circulator module 380D, the streams of both heaters bypass the elements of the other heater and only their streams A and B meet and give energy at common ductwork circulation areas.

Figure 3A:
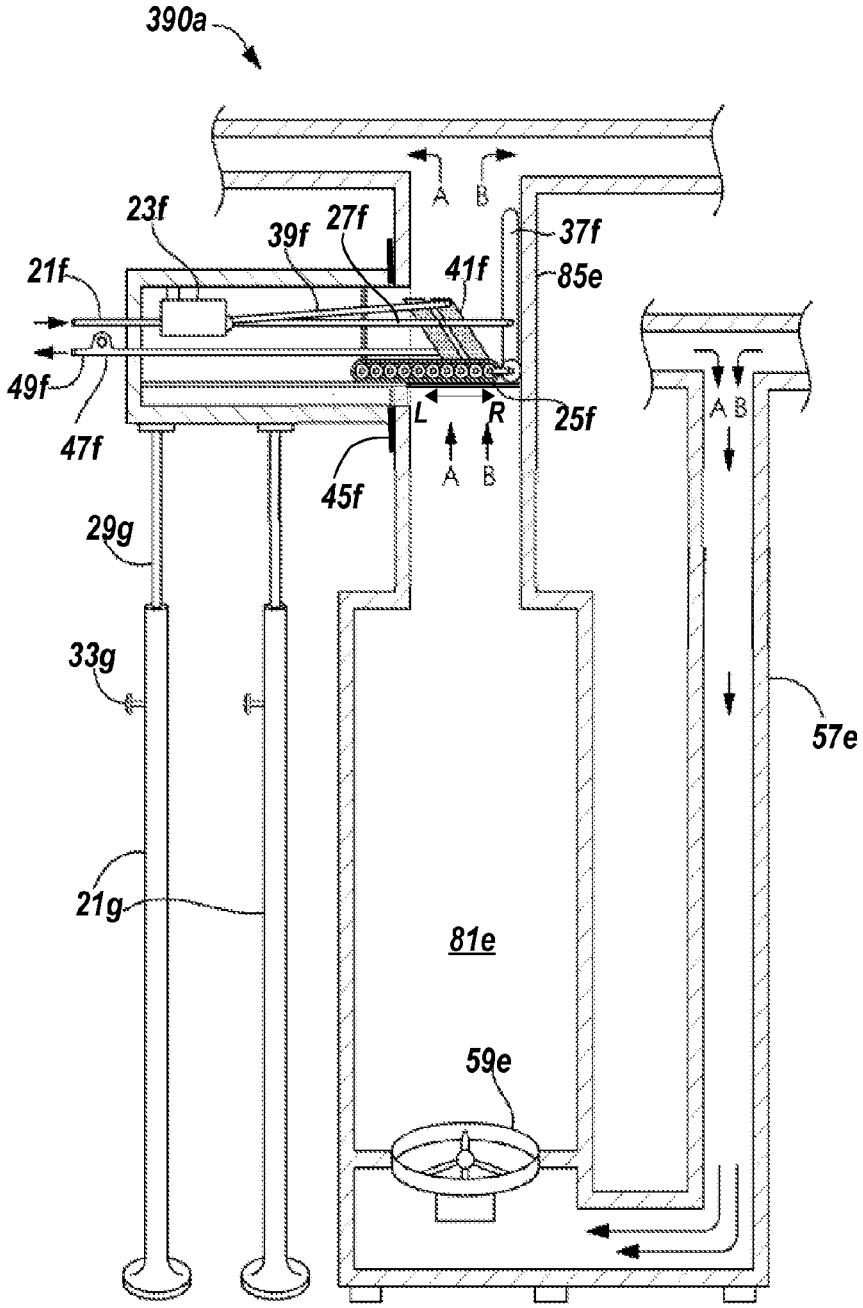
FIG. 3A shows side view of one embodiment of projection auxiliary heat ejector installed in a plenum of a central circulation ductwork with a primary heater.

FIG. 3A illustrates an application of the embodiments of the projection auxiliary heater 390 generally regarded as installed projection auxiliary heater 390A. The installed projection auxiliary heater 390A comprises of the projection auxiliary heater 390 installed with flanges 45*f*, auxiliary support 21*g*, in the plenum 85*e* of a ductwork having the primary heater 81*e*, the air return duct 57*e* and the primary blower 59*e* blowing the arbitrary circulation stream A and B. The installation shows the second stage actuation of the projection telescopic piston 27*f* to push the cart wheel 25*f* with radiators 41*f* into the plenum 85*e* where circulation stream A and B from the primary blower 59*e* is in use with or without the primary furnace in operation.

Figure 5:
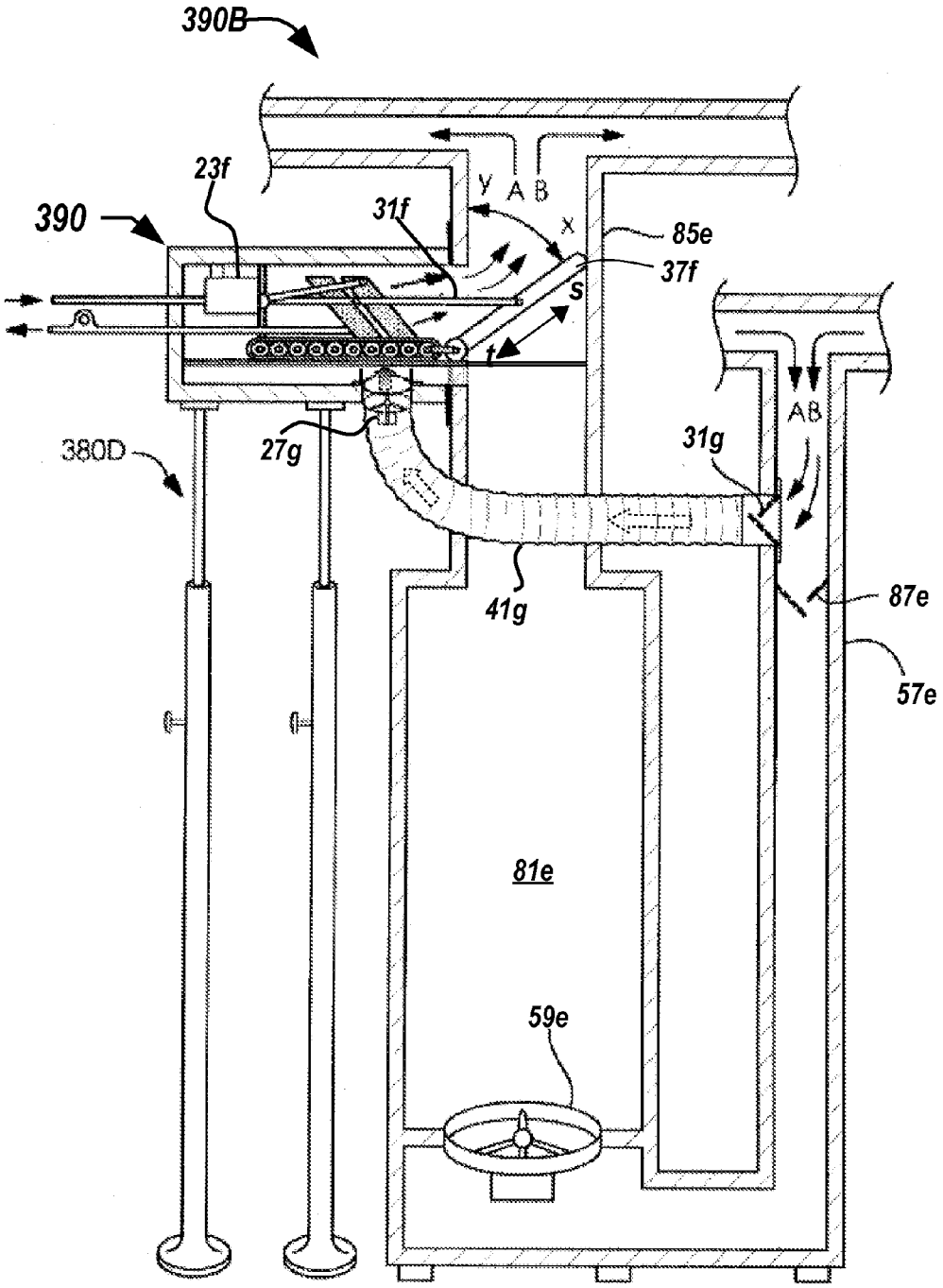
FIG. 5 shows side view of one embodiment of projection auxiliary heater combined with a flexible independent circulator module in operation and installed in a plenum of a central circulation ductwork with a primary heater.
Figure 5A:
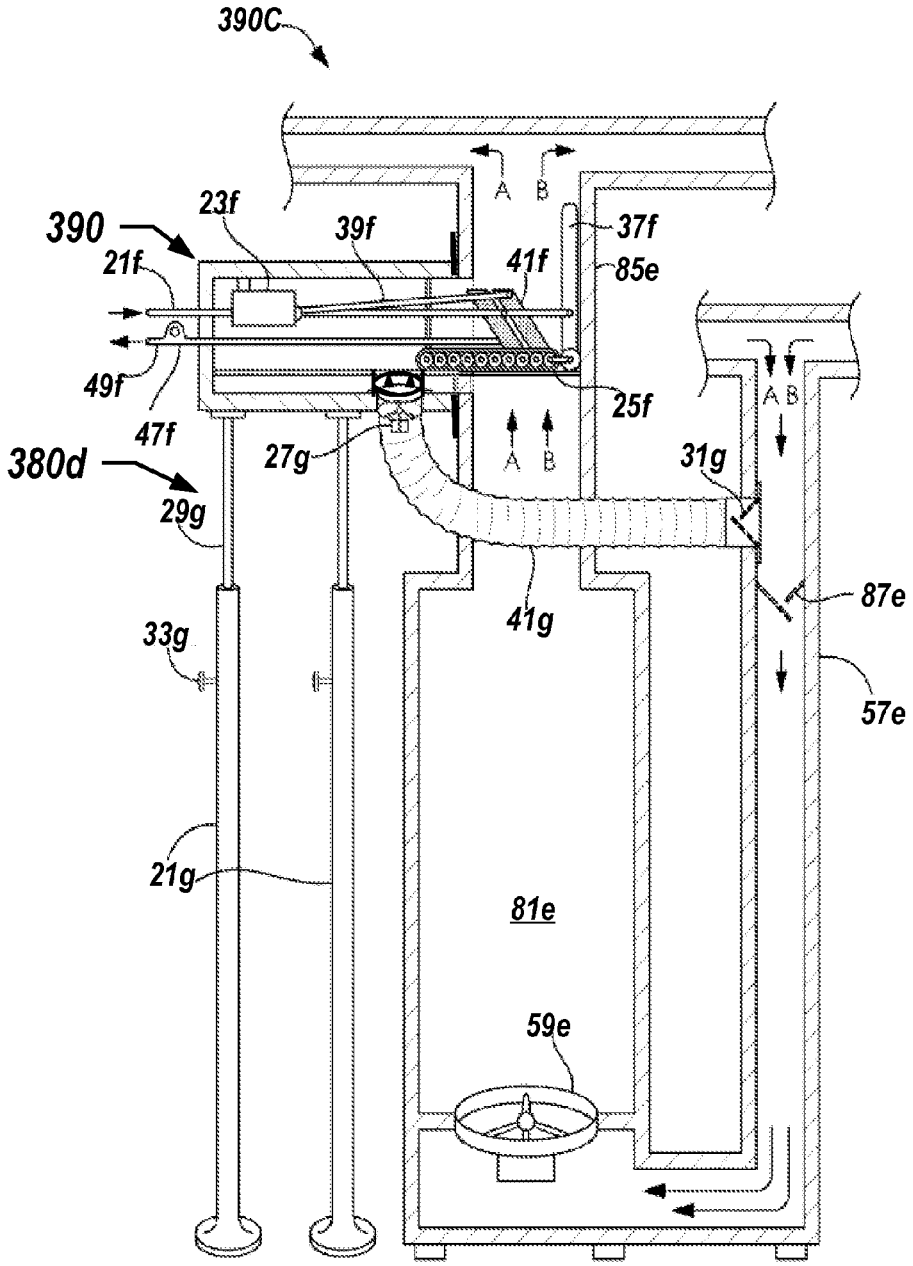
FIG. 5A shows side view of one embodiment of projection auxiliary heat ejector combined with a flexible independent circulation module combined and installed in a plenum of a central circulation ductwork.

FIG. 5, generally regarded as installed retractable auxiliary heater with independent circulator module 390B shows the addition and operation of the installed projection auxiliary heater 390A with its own blower, the independent circulator module 380D as an option. The operation shows the first stage actuation of the sole-share partition 37*f* pivoting from Y to X while the length is stretched from T to S to take sole use of the ductwork. An actuation that pivots the sole-share partitions 37*f* between Y and X or an adjustment that leaves the sole-share partition 37*f* between S and T will result in a shared ductwork where stream B flow through the independent circulator module 380D and projection auxiliary heater 390 and stream A passes through the primary furnace 81*e* only. Where there is no actuation, the share partitions 37*f* closes-out the installed auxiliary heater independent circulator 380E by remaining at Y position and the primary heater has 100% unobstructed use of the ductwork. With the use of the independent circulator module 380D, the streams of both heaters bypass the elements of the other heater and only their streams A and B meet and give energy at common ductwork circulation areas. FIG. 5A, generally regarded as installed retractable auxiliary heater with independent circulator module operating with main furnace blower 390C shows the addition of the independent circulator module 380D as an option, the installation can still be used as in the installed projection auxiliary heater 390A manner.

FIG. 1C illustrates an energy integration system (known as 380F) of the installed transporting heat ejector 380C connected by hot fluid line 69*e* and cold fluid return line 71*e* in tandem with a side view of energy source 30E comprising of impeller draft inducer 50 with Hollow helical Heat reclaimer smoke condenser 110 and sweep access 710 modules connected to an insert appliance 67*a* in an existing chimney. The energy source has a chimney wall 61 with flue pipe 63 and a sweep through brush 55 that demonstrates the hollow design.

Figure 4A:
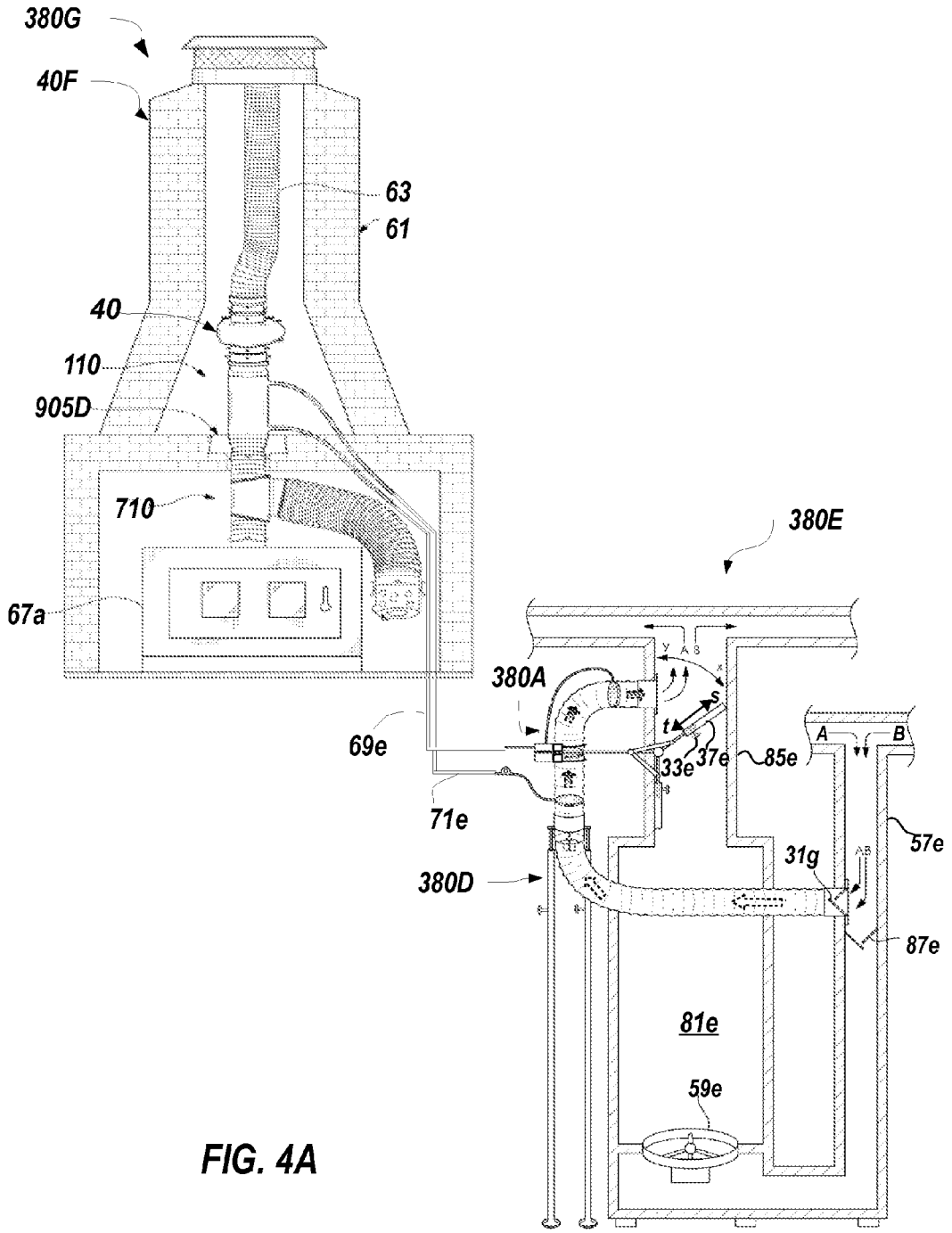
FIG. 4A shows front view of one modular tandem of Access connector on a solid fuel appliance in a chimney, combined with hollow heat reclaimer smoke condenser and hollow draft inducer connected to the flexible auxiliary heater combined with flexible independent circulator module combined and installed in a central circulation ductwork with a primary heater.
Figure 4B:
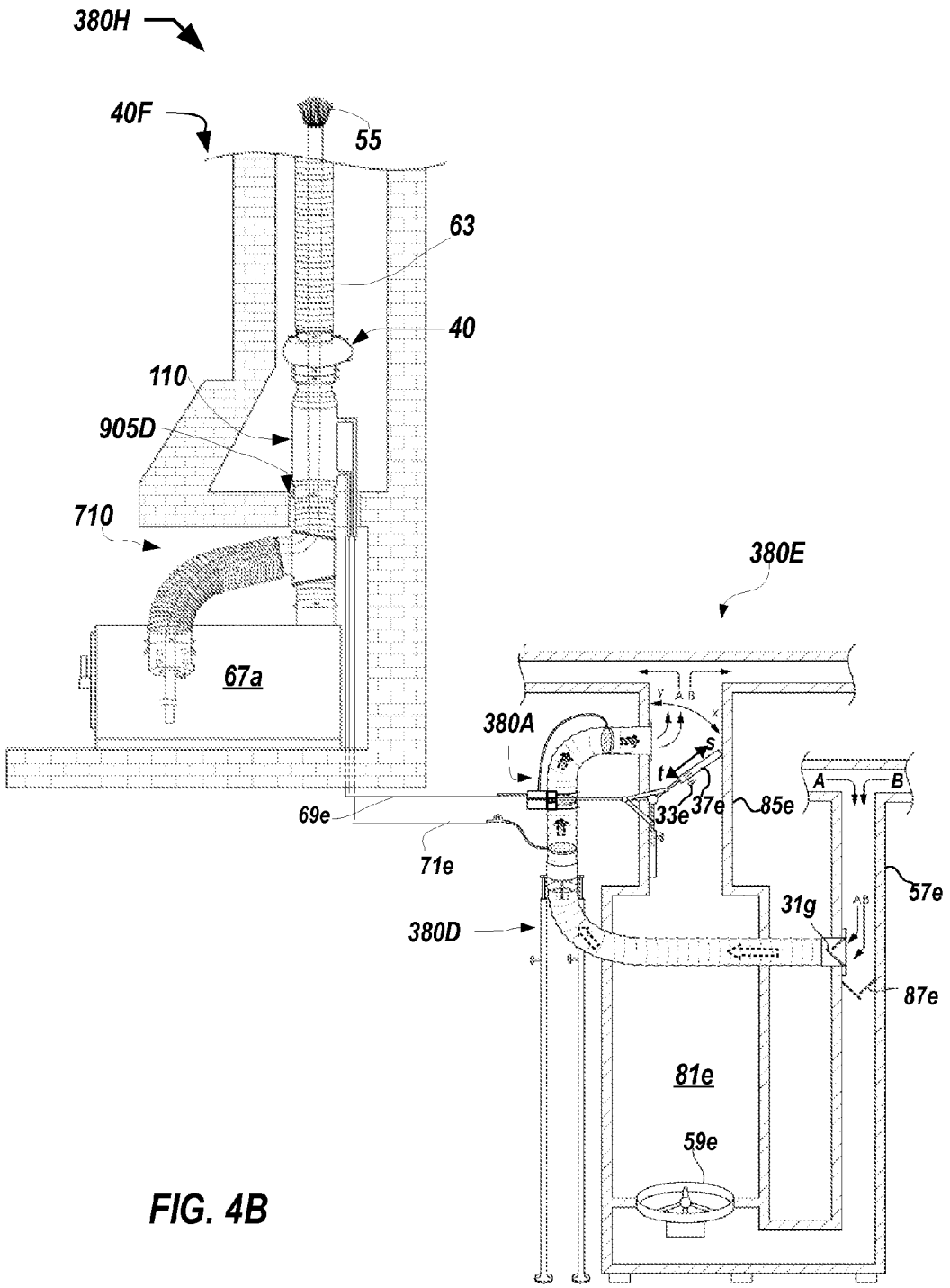
FIG. 4B shows side view of one embodiment of flexible auxiliary heater with a flexible independent circulator module installed in a central circulation ductwork and connected to a side view modular tandem of Access connector, heat reclaimer smoke condenser and a hollow draft inducer on a solid fuel appliance in a chimney.

FIG. 4A illustrates another energy integration system (known as 380G) of the installed transporting heat ejector 380E connected by hot fluid line 69*e* and cold fluid return line 71*e* in tandem with a front view of energy source 40E comprising of propeller draft inducer 40 with Hollow helical Heat reclaimer smoke condenser 110 and sweep access 710 modules connected to an insert appliance 67*a* in an existing chimney. The energy source has a chimney wall 61 with flue pipe 63 and the shows a damper hole sealer 905D used in the installation. FIG. 4B, known as energy integration system 380H, illustrates the side view of the energy source 40E of the energy integration system 380G.

Figure 3B:
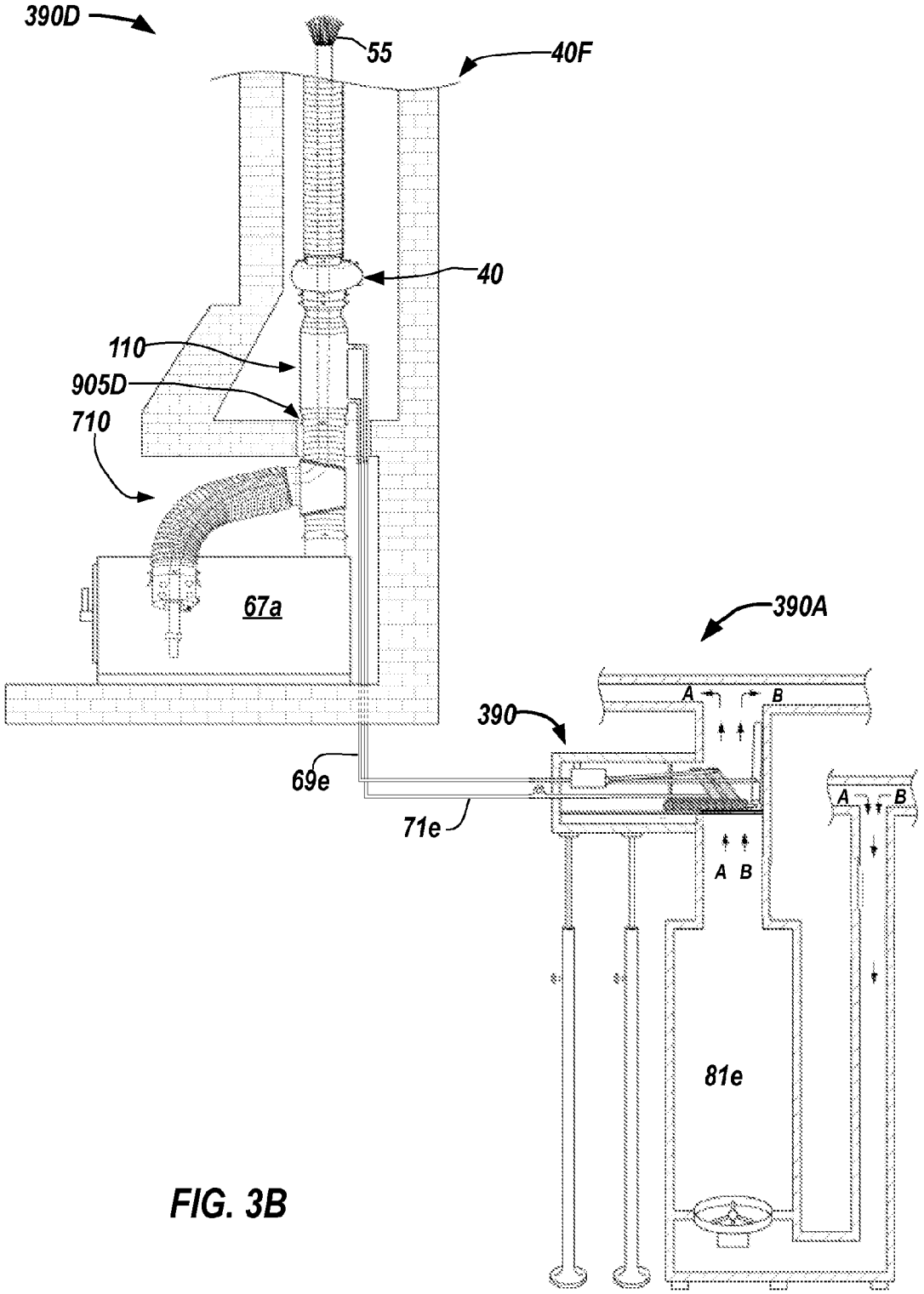
FIG. 3B shows side view of one embodiment of projection auxiliary heat ejector module installed in a ductwork air distribution vent and return system and connected to a side view modular tandem of Access connector, heat reclaimer smoke condenser and a hollow propeller draft inducer on a solid fuel appliance in a chimney.
Figure 5B:
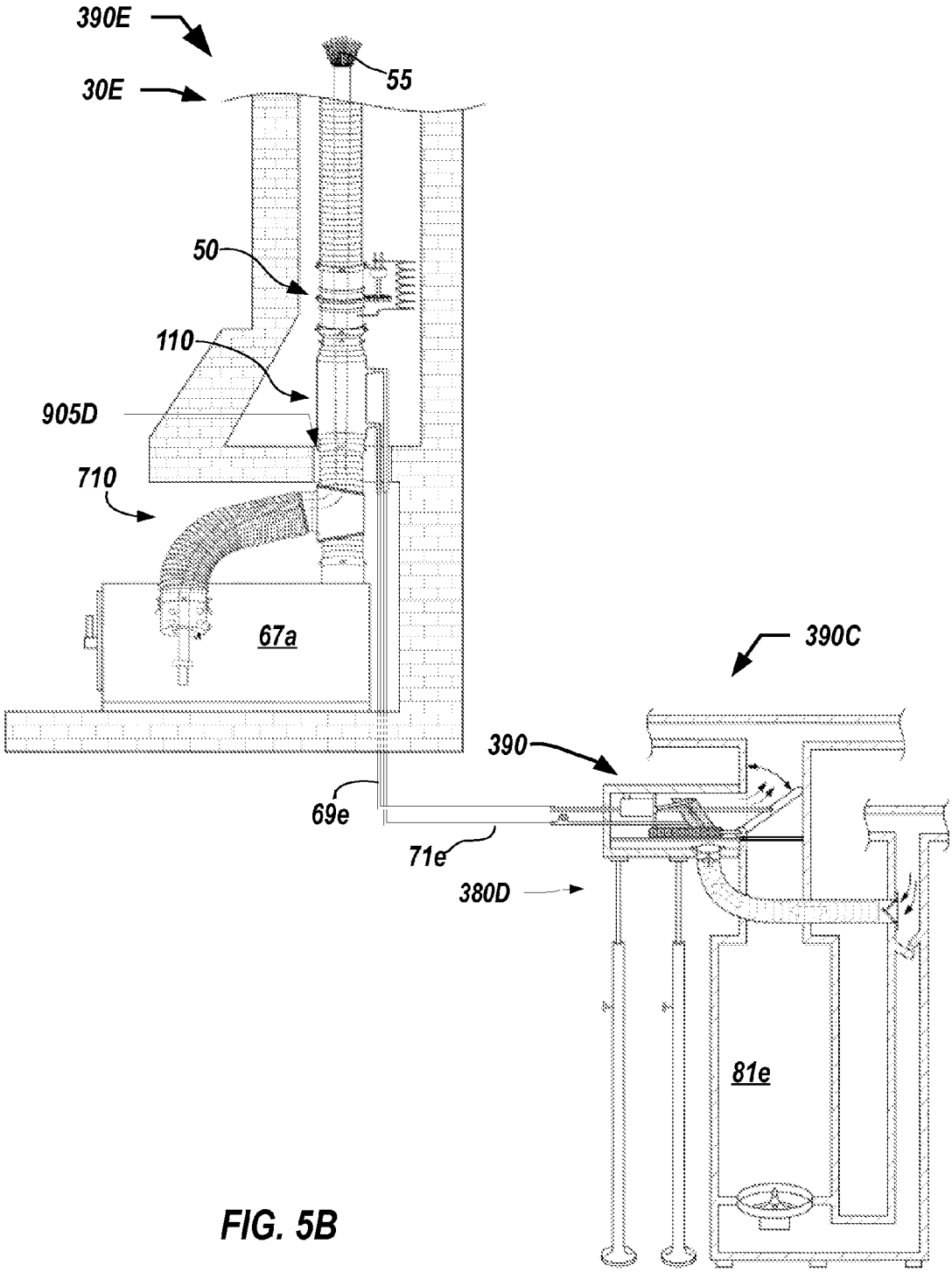
FIG. 5B shows side view of one embodiment of projection auxiliary heat ejector with a flexible independent circulator module installed in a central circulation ductwork and connected to a side view modular tandem of Access connector, heat reclaimer smoke condenser and a hollow impeller draft inducer on a solid fuel appliance in a chimney.

FIG. 3B illustrates an alternate energy integration system 390D comprising of the installed projection auxiliary heater 390A connected by hot fluid line 69*e* and cold fluid return line 71*e* in tandem with a side view of energy source 40F comprising of impeller draft inducer 40 with Hollow helical Heat reclaimer smoke condenser 110 and sweep access 710 modules connected to an insert appliance 67*a* in an existing chimney. The energy source has a chimney wall 61 with flue pipe 63, a damper hole sealer 905D used in the installation and a sweep through brush 55 that demonstrates the hollow design. FIG. 5B, known as energy integration system 390E, illustrates the interchangeable use of hollow inducer 50 of the energy source 30E in place of the hollow inducer 40 of the energy source 40F of the energy integration system 390D.

An auxiliary heater is obtained in another application of my referenced prior art comprising: hollow inducers claimed 50, heat reclaimer smoke condenser 110, and flexible universal flue pipe connector with damper and sweep access 710. In FIG. 5B the hollow inducers 50 is connected to heat reclaimer smoke condenser 110 connected to flexible universal flue pipe connector with damper and sweep access and connected to combustion appliance 67*a* in an energy source tandem. In FIGS. 4B and 5B the independent circulator module 380D can be replace using flexible universal flue pipe connector with damper and sweep access 710 connected to hollow inducers 50, as blower connected to heat reclaimer smoke condenser 110 as the projection or flexible auxiliary heater 390 and another flexible universal flue pipe connector with damper and sweep access 710 for connecting to a plenum, ductwork or other module. Modifications: the inducer blowing air into (instead of out of) the heat reclaimer smoke condenser 110. The fluid flow connection to the reclaimer smoke condenser 110 is reversed to make a more efficient counter-current heat exchange. The universal flue pipe connector with damper and sweep access 710 connects one end to the air return ductwork 59*e* and the other to the inducer 50 now as blower. Another modification is the provision of pump and the damper is used as flow check guard. A partition is opened by force of air and closed by a return spring at the intersection with the ductwork or plenum.

Some advantages are that pluralities of heat sources and ductworks or plenums can be connected to the flexible universal flue pipe connector with damper and sweep access 710 and more laminar flow when the inducer 50 with no motor in the stream is used.

ADVANTAGES

As can be seen from the description above, some embodiments of the auxiliary heater have a number of advantages:

1. Versatile: Provides a modular auxiliary heat transport for used with heat energy sources such as hollow heat reclaimer smoke condenser (110), solar energy, geothermal energy, incinerator and the like that can produce heated fluid. Provide a different kind of heat exchange means that can be positioned with various ductwork without major installation and equipment. It is not obstructing and requires minimal tools for repair or perform routine maintenance. It can portably be relocated and fits any ductwork and many locations in the ductwork and can be positioned modularly in tandem with itself and/or other modules.
2. Heat Source in Emergency: The independent circulator motor and pump motors may be operated by a DC power with battery backup. The DC power is transformed and rectified from a utility volt AC source. When there is power outage, the auxiliary heater can be powered by a DC backup battery.
3. Durable: Any system motor is positioned such that only cold return air passes through it and never exposed to hot stream. The motor for the primary blower and/or the independent circulator blower are never exposed to each other's hot stream. The motors are saved from hot air and short life span
4. Safer: Unexposed motors mean safety. Different system heaters' exchange elements are rarely interchanging heat. Limited chances of breakdowns or disastrous event can occur in the isolation of the primary and auxiliary heaters in this system.
5. Robust Choice of Operating Modes: The primary heater can operate without effect and interference from the auxiliary heater. When equipped with the independent circulator module, the auxiliary heater can operate without effect and interference from the main heater.
6. Supports heat energy recovery and smoke condensing: With the invention of the access connector (710), the heat reclaimer smoke condenser (110) and the hollow inducer (40, 50), the auxiliary heaters provides efficient and economical distribution of the energy to an entire structure.
7. On-demand Presence: Presence of the flexible or the projection heat ejector in the ductwork path is minimized or absent when the heat ejector is not in use. This implies that the ductwork is fully usable in its original form. This feature is particularly valuable when there is power outage or malfunction of either the auxiliary or primary heater. The auxiliary heaters have zero failure effect because it is only present on-demand and not obstructive.

The auxiliary heater includes a heat rejection element that radiates heat from a heated fluid, rejects the heat into the shared circulating ductwork.

It further provides a different kind of auxiliary heat ejection means into main distribution duct outlets directly to all living space.

In another embodiment, the heat exchange apparatus includes a hydraulic and/or electric actuator that that engages the air stream to flow through the heat rejection element and return back to the circulation duct.

In another embodiment, the heat exchange apparatus includes sharing the circulation blower of the primary heating system from the return air.

The heat exchange apparatus is attachable to air circulating ductwork and does not affect the circulation flow in the duct until the actuator is actuated by the heated auxiliary hydraulic fluid flow from the pump.

When the share partition is actuated, half midstream of the return ductwork, a portion or the air stream passes thru the auxiliary heater to collect heat while the other half air stream continues from the primary heater.

CONCLUSION, RAMIFICATION AND SCOPE

Accordingly, it can be appreciated by the reader that the heat ejector with various modulating embodiments can be used to safely transport thermal energy from any remote fluid heat source to a general ductwork. It can also be appreciated that the auxiliary heater can use the ductwork in a shared mode, a dependent mode and independent mode. It can be seen that the auxiliary heater has on-demand presence in the ductwork, and no obstruction or increased pressure on another blower in the system. Additional advantages of the auxiliary heater are:

They are relatively simple and easy to manufacture; installation can be performed with minimal installation equipment, time and cost. Service and repair is equally simple and require minimal tools.

The auxiliary heaters have controlled gates that open and close on demand to channel air flow through the auxiliary heat exchanger into the distribution duct. It is designed to integrate any fluid heat source to shared ductwork and to circulate extracted heat of hot fluid from a heat source such as waste flue gas of combustion, geothermal, solar heat panel and the like into a living space.

They clearly have the advantage in failure effect mode analysis in that the ductwork can still be used in its original form.

This invention provides apparatus with capabilities of sole, partial or simultaneous utilization of a ductwork and useable in emergency power outage.

Seamlessly integrates heaters into sharing one duct system. The auxiliary heat ejector meets standards of safety, cost effective and less on labor. The auxiliary heater can perform when primary heating system is idle or out of service.

The embodiments illustrated in this invention are in no way restricted to changes and modification that may be made without departing from the scope of this invention. Although the drawings and detailed descriptions above contain much specificity, those should not be construed as limiting the scope of the embodiments but as merely providing illustration of some of the embodiments. For example, the inverse substitution use of the hollow heat reclaimer smoke condenser 110 in place of the transporting heat ejector 380A and reverse use of the hollow inducer 50 in place of the independent circulator module has been mentioned 380D. The embodiments are modular and capable of numerous modifications, rearrangements, and substitutions of parts and elements without departing from the scope of the invention. Thus the scope of the embodiment should be determined by the appended claims and the legal equivalents, rather than the examples given.

What is claimed is:

1. A transporting and integrating heat ejector device (380A) for transferring heat from a heated fluid source to a distributing central heating ductwork plenum (85*e*) and comprising:

a flexible, corrugated, body (53*e*) enclosing pluralities of heat exchange radiators (41*e*) interconnected in series with stretchable coils (43*e*) inside the said insulated body (53*e*); the first of said radiators having an inlet connected to an insulated inlet pipe (21*e*) which is connected to a heating source (30E, 40F) outlet through a hydraulic actuator (23*e*) and the last of said radiators having an outlet connected to an outlet pipe (47*e*) which is connected to a fluid pump (49*e*) inlet; the said pump having an outlet connected to said hydraulic actuator (23*e*) and the actuator connected to a return inlet of said heating source (30E, 40F) to complete a fluid closed loop; said body (53*e*) having at least two open ends with flanges (45*e*) for connecting the open ends of said body to a plenum (85*e*) of a ductwork in closed loop air distribution configuration; and further comprising:

(a) actuated partitions (37*e*) that partition said ductwork plenum (85*e*) and have sole-share adjusters (33*e*) for prioritizing proportion of share; said partitions being connected to controllers (29*e* and 31*e*) and said controllers being connected to a piston (27*e*) and said piston connected to said actuator (23*e*) for auto control of said partitions;

(b) said pump (49*e*) being configured for circulation of heat depleted fluid from said last radiator having outlet line (47*e*) connected to said hydraulic actuator though a fluid pipe (22*e*) to an inlet of said heating source (30E, 40F) where it is heated and circulated to the first radiator (41*e*) inlet via a fluid pipe (21*e*) to said first radiator (41*e*) inlet in the body (53*e*) of an installed heat ejector (380*a*) that ejects heat into a distributing ductwork plenum (85*e*) where the heated fluid flows and a heat exchange return air (A, B) flows from ductwork air return through said radiators (41*e*) in opposite direction in a maximized counter current exchange arrangement; the closed loop circulation of fluid configured to provide a heat source to the return air (A, B) via the heat exchange radiators (41*e*);

(c) a partition actuator (23*e*) is connected to said corrugated body (53*e*) by an actuator fastener (51*e*) and said actuator has an actuator piston (27*e*) with a recoil spring (25*e*) for recoil return motion of said actuator piston (27*e*);

(d) having said piston with return recoil springs (25*e*) connected to said controllers (29*e*, 31 *e*) that controls access to the said ductwork plenum using share-partitions (35*e*) and sole-partitions (37*e*) to adjustably slide over pivoting share-partitions.

2. A heat transporting ejector according to claim 1 wherein said actuator is also electrically powered.

3. A transporting heat ejector according to claim 1 having said pump being optionally powered by a high voltage AC or a step down transformed and rectified DC current with a backup rechargeable battery which provides for operation in event of power failure.

4. A transporting heat ejector according to claim 1 having zero failure mode effect that allows ductwork and plenum to be used in its form before heat ejector installation, making the heat ejector available on-demand.

5. A remote distance transporting and integrating heat ejector device (390, 390A) with an insulated rigid geometric body (53*f*) for transferring heat from a heated fluid source (30E, 40F) to a distributing central heating ductwork plenum and comprising:

a cart (33*f*) on a cart rails (59*f*); said cart rails spanning from one end of said body (53*f*) to an opposite end of a plenum (85*e*) or an air circulation ductwork, said cart being configured to insert and retract its presence into and out of the ductwork flow path via the rails;

the said body having flanges (45*f*) for connecting to said plenum; said body (53*f*) enclosing pluralities of heat exchange radiators (41*f*) stacked and connected in series;

partitions (37*f*) for partitioning heating shared or sole-shared ductwork;

a pump (49*f*) being configured for circulation of a heated fluid from a hot fluid heating source (30E, 40F) to an installed heat ejector (390) that ejects heat into a distributing central heating ductwork plenum (85*e*) and circulates heat depleted cold fluid back to a heating source (30E, 40F) system;

a partition actuator (23*f*) connected to the body (53*f*) by an actuator support (57*f*) and connected to said actuator is an actuator piston (27*f*) having internal recoil spring (25*e*) for reverse motion of said actuator piston (27*f*) when said actuation is turned off; and further comprising:

(a) a heated fluid inlet line (21*f*) from a remote heating source (30E, 40F) connected to a first radiator (41*f*) in said series; and (b) module connection (61*f*) under and between said pair of parallel cart wheels and cart rail for an independent circulation module connection.

6. A heater according to claim 5 having two stage telescopic actuator piston comprising of a first stage partition telescopic piston (31*f*) that projects from said actuator (23*f*) to a partition controller (35*f*) connected to a sole-share partition;

said partition is pivotally connected to an end of the cart-wheels; said pistons have internal recoil spring for reverse motion when actuation is turned off; a second sage projection telescopic piston (39*f*) that projects said cart on cart rail when actuated and said recoil spring retracts said cart when actuation power is off or system failure occurs.

7. A heater according to claim 5 wherein hot fluid passes through said actuator to a top heat exchange radiators and exit at a bottom radiator through exchange fluid return line and exchange air passed from bottom to top, in a counter-current exchange.

8. A heater according to claim 5 wherein a heat ejector when connected to an independent circulator module has the capability and provides a choice of using a primary heater blower or said independent circulator module for air closed loop ductwork circulation.

9. A heater according to claim 5 wherein radiators in said body are sequentially arranged to provide opposite direction flow of air to provide counter current heat exchange in both fluid and return air closed loop systems.

* * * * *